US010399730B2

(12) United States Patent
Habibi-Naini et al.

(10) Patent No.: US 10,399,730 B2
(45) Date of Patent: Sep. 3, 2019

(54) SET OF MULTICOMPONENT CARTRIDGES

(75) Inventors: Sasan Habibi-Naini, Rikon (CH); Markus Scheuber, Winterthur (CH)

(73) Assignee: SULZER MIXPAC AG, Haag (CH)

( * ) Notice: Subject to any disclaimer, the term of this patent is extended or adjusted under 35 U.S.C. 154(b) by 485 days.

(21) Appl. No.: 14/119,268

(22) PCT Filed: Apr. 30, 2012

(86) PCT No.: PCT/EP2012/057894

§ 371 (c)(1),
(2), (4) Date: Nov. 21, 2013

(87) PCT Pub. No.: WO2012/168002

PCT Pub. Date: Dec. 13, 2012

(65) Prior Publication Data

US 2014/0091094 A1 Apr. 3, 2014

(30) Foreign Application Priority Data

Jun. 6, 2011 (EP) ..... 11168751

(51) Int. Cl.
*B65D 50/00* (2006.01)
*B65D 1/04* (2006.01)
(Continued)

(52) U.S. Cl.
CPC ..... *B65D 1/04* (2013.01); *B65D 25/38* (2013.01); *B65D 81/325* (2013.01); *B65D 81/3283* (2013.01)

(58) Field of Classification Search
CPC ..... B65D 1/04; B65D 25/38; B65D 81/325; B65D 81/3283; B65D 25/52
(Continued)

(56) References Cited

U.S. PATENT DOCUMENTS 2,318,778 A * 5/1943 Hines ..... B65D 81/3288 206/229
6,874,661 B2 4/2005 Timmerman et al.
(Continued)

FOREIGN PATENT DOCUMENTS

CH 669 164 A5 2/1989
CN 1533957 A 10/2004
(Continued)

OTHER PUBLICATIONS

International Search Report for International Patent Application No. PCT/EP2012/057894 dated Jul. 17, 2012.
(Continued)

*Primary Examiner* — Andrew T Kirsch
*Assistant Examiner* — Elizabeth J Volz
(74) *Attorney, Agent, or Firm* — Global IP Counselors, LLP

(57) ABSTRACT

A set of multicomponent cartridges is proposed having at least two multicomponent cartridges (2), with each multicomponent cartridge (2) including at least one first and one second reception chamber (3, 4) for components to be dispensed, with each reception chamber (3, 4) having a substantially cylindrical design and extending in a longitudinal direction (A), with the reception chambers (3, 4) being arranged parallel to one another and having the same extent (L) in the longitudinal direction (A), with each multicomponent cartridge (2) being manufactured in one piece so that their reception chambers (3, 4) are non-releasably connected to one another, and wherein the first reception chamber (3) of each multicomponent cartridge (2) of the set (2) has the same outer diameter (D1).

17 Claims, 4 Drawing Sheets

(51) Int. Cl.
*B65D 81/32* (2006.01)
*B65D 25/38* (2006.01)

(58) Field of Classification Search
USPC ..... 220/500; 215/40, 45, 222, 355, 6, 215/DIG. 8; 206/568; 222/94, 145.1, 222/134
See application file for complete search history.

(56) References Cited

U.S. PATENT DOCUMENTS

| | | | | |
|---|---|---|---|---|
| 8,376,187 | B2 | 2/2013 | Keller | |
| 8,672,188 | B2 | 3/2014 | Rotz et al. | |
| 2002/0170926 | A1* | 11/2002 | Horner et al. | 222/137 |
| 2004/0188465 | A1 | 9/2004 | Timmerman et al. | |
| 2008/0144426 | A1 | 6/2008 | Janssen et al. | |
| 2009/0127289 | A1* | 5/2009 | Keller | B05C 17/00509 222/135 |
| 2010/0102088 | A1* | 4/2010 | Keller | B65D 81/325 222/137 |
| 2010/0200614 | A1* | 8/2010 | Von Rotz | B01F 5/0615 222/145.5 |
| 2014/0117041 | A1* | 5/2014 | Springhorn | B05C 17/00586 222/83 |

FOREIGN PATENT DOCUMENTS

| | | | |
|---|---|---|---|
| CN | 100439218 | C | 12/2008 |
| CN | 101829512 | A | 9/2010 |
| EP | 1 440 737 | A1 | 7/2004 |
| JP | 60-148271 | U1 | 10/1985 |
| WO | 2008113196 | A1 | 9/2008 |

OTHER PUBLICATIONS

Written Opinion for International Patent Application No. PCT/EP2012/057894 dated Jul. 17, 2012.
International Preliminary Report for International Patent Application No. PCT/EP2012/057894 dated Dec. 31, 2013.

* cited by examiner

SET OF MULTICOMPONENT CARTRIDGES

PRIORITY CLAIM

The present application is a National Stage of International Application No. PCT/EP2012/057897, filed on Apr. 30, 2012, which claims priority to European Patent Application No. 11168751.3 filed on Jun. 6, 2011, the entire contents of which are being incorporated herein by reference.

The invention relates to a set of multicomponent cartridges having at least two multicomponent cartridges in accordance with the preamble of the independent claim.

Multicomponent cartridges and in particular two-component cartridges are frequently used for storing and for dispensing multicomponent and two-component systems in which the individual components should only come into contact with one another for the respective application to then harden, for example. For this purpose, two or more mutually separate reception chambers are provided of which each contains one of the components. The outlets of the reception chambers are then typically connected to a static mixer for the application and the components are conveyed by application of pressure on the rear base of the respective reception chamber, said base usually being designed as a movable piston, through the outlet into the mixer where the components are intimately mixed in order then to exit at the end of the mixer as a homogenous mixture.

Such multicomponent or two-component systems are used in the industrial sector, in the construction industry, for example of buildings, and also in the dental sector. Some application examples are caulking compounds, compounds for chemical dowels or chemical anchors, adhesives, pastes or impression materials in the dental sector. Two-component systems are in particular also used in the industrial sector for paints which are used, for example, as functional protective layers such as for corrosion protection. For this purpose, the two components of the paints are mixed in a static mixer and then supplied to a spray nozzle which atomizes the mixed components by exertion of a medium such as compressed air and are transported onto the surface to be treated. It is also known, in addition to the spraying on of such coatings, to apply protective layers or coatings generally by brushing on, spreading or application by a spatula.

These multicomponent cartridges are usually produced from plastic and are manufactured in an injection molding process. It is customary today, in particular with the two-component cartridges, to design them as so-called side-by-side cartridges in which the two substantially cylindrical reception chambers are arranged next to one another in an axial parallel manner. For this purpose, for a production process which is as economic as possible, the two-component cartridges are manufactured in one piece in a single-stage injection molding process so that the two reception chambers are non-releasably connected to one another.

Special dispensing apparatus, which are also simply called dispenses, are used for dispensing the components from the multicomponent cartridges. These dispensing apparatus are designed so that the multicomponent cartridges are inserted in holders of the dispensing apparatus especially designed for this purpose. Plungers are then provided for the dispensing of the components which apply pressure to the pistons forming the base of the reception chamber, whereby the pistons are moved along the wall of the respective reception chamber and thereby convey the component through the outlet in the mixer, for example. Depending on the system, the drive of the plungers can take place manually, for example via a handle whose actuation results by means of a translation in a forward movement of the plungers. The dispensing apparatus, however, frequently also have electrically or pneumatically or hydraulically driven plungers which can be activated by the user by an actuator to start the dispensing of the components.

Depending on the application, the two—or more—components have to be mixed with one another in different volume ratios in order ideally to achieve the desired reaction on mixing. The different volume ratios are in this respect realized via different volumes of the reception chambers. Since it is advantageous under practical aspects and for cooperating with the dispensing apparatus, the two—or more—reception chambers of the multicomponent cartridge are designed with the same length so that the plungers of the dispensing apparatus can always be moved forward synchronously and as a whole. The different volume ratios are then realized by different cross-sectional surfaces of the reception chambers. If, for example, it was desired to achieve a mixing ratio of the two components of 2:1 with a two-component system, the first reception chamber is designed with a cross-sectional surface twice as large as that of the second reception chamber with the same length of the two reception chambers.

It has long been established in practice that the multicomponent systems and in particular the two-component systems are offered in different standardized sizes, i.e. filling quantities, with always the total filling quantity of both or all reception chambers being given as the filling quantity. Thus, for example, with a two-component cartridge, the size indication "1500 ml" means that the total filling volume of both reception chambers amounts to 1500 ml in total. This has the consequence that 1500 ml two-component cartridges vary greatly from their outer dimensions for different mixing ratios of the components. Thus, for example, for a mixing ratio of one to one, the volume of each reception chamber is 750 ml, whereas for a mixing ratio of the components of two to one, the first reception chamber includes 1000 ml and the second reception chamber 500 ml. With a mixing ratio of four to one, the first reception chamber has a volume of 1200 ml, whereas the second reception chamber has a volume of 300 ml. Since, as already mentioned, the length of the reception chambers should be the same for practical reasons, it necessarily results that the outer diameters of both reception chambers have to be modified to realize different mixing ratios. This has the consequence that different dispensing apparatus must also be provided since the multicomponent cartridge has to be stored reliably and in a stable manner in the dispensing apparatus so that the pistons can have sufficient pressure applied to them.

Starting from this prior art, it is therefore an object of the invention to propose a set of multicomponent cartridges with which different mixing ratios can be realized and which can be used more universally than known systems.

The subject of the invention satisfying this object is characterized by the features of the independent claim.

In accordance with the invention, a set of multicomponent cartridges having at least two multicomponent cartridges is therefore proposed, with each multicomponent cartridge including at least one first reception chamber and one second reception chamber for components to be dispensed, with each reception chamber being designed substantially cylindrically and extending in a longitudinal direction, with the reception chambers being arranged parallel to one another and having the same extent in the longitudinal direction, with each multicomponent cartridge being manufactured in one piece so that its reception chambers are non-releasably connected to one another, and with the first reception chamber of each multicomponent cartridge of the set having the same outer diameter.

A considerably more universal usability of the multicomponent cartridge results by the measure of in each case designing the outer diameter of the first reception chamber with the same outer diameter in the set of multicomponent cartridges. Since the multicomponent cartridge is moreover made in one piece so that its reception chambers are non-releasably connected to one another, it is sufficient if only a respective one of the reception chambers is received with an exact fit in a holder in the dispensing apparatus. Since the outer diameter of the first reception chamber is always the same for the whole set of multicomponent cartridges, it is made possible that all multicomponent cartridges of the set can be dispensed with the same dispensing apparatus. Different dispensing apparatus are no longer required if multicomponent cartridges should be dispenses with different mixing ratios. This means a considerably more universal and more flexible use of the set of multicomponent cartridges in accordance with the invention than with previously known systems.

It is in particular preferred if each first reception chamber has the same volume. This means that in each case the wall thickness of the first reception chamber, and thus also its inner diameter, is also the same in the different multicomponent cartridges of a set. This has the advantageous effect that the number of different pistons which are provided for the multicomponent cartridges can be considerably reduced.

In a preferred embodiment, each multicomponent cartridge is a two-component cartridge since this application is a very important one for practice.

It is particularly suitable if each multicomponent cartridge is manufactured by means of an injection molding process. This process is economical, very efficient and has proven itself for multicomponent cartridges.

An advantage measure is if each reception chamber has a separate outlet through which the component can be dispensed from the respective reception chamber. Since the outlets are completely separate from one another, the risk of a cross-contamination between the outlets can be at least reduced. If the different components were already to come into contact at the outlets, a hardening could already occur here, whereby the outlets are clogged.

It is particularly advantageous for the application if all the outlets in each multicomponent cartridge are arranged in a common connector piece which is designed for cooperating with an accessory part, in particular with a closure cap or with a mixer. The multicomponent cartridge can be operated particularly easily through this common connector piece.

It is a preferred measure if the connector piece has a thread for cooperating with the accessory part because a secure connection is hereby ensured. Other variants can, however, also be realized by which the connector piece can be connected to a closure cap or to a mixer.

Another likewise preferred measure is if the connector piece has a bayonet coupling for cooperating with the accessory part. The connector piece is then designed for a bayonet connection with an accessory part such as a mixer or a closure cap. Such a bayonet connection between the multicomponent cartridge and a mixer or a closure cap which is prior art per se represents a reliable connection which is very simple to operate.

A piston is preferably provided for each reception chamber which forms the chamber base and by which the component can be dispensed from the respective reception chamber by application of pressure. This embodiment has particularly proved itself in practice.

Based on practical experience, it is preferred if the set includes a multicomponent cartridge in which the volume of the first reception chamber is of the same size as the volume of the second reception chamber; and/or a multicomponent cartridge in which the ratio of the volume of the first reception chamber to the volume of the second reception chamber is two to one; and/or a multicomponent cartridge in which the ratio of the volume of the first reception chamber to the volume of the second reception chamber is three to one; and/or a multicomponent cartridge in which the ratio of the volume of the first reception chamber to the volume of the second reception chamber is four to one.

Further advantageous measures and embodiments of the invention result from the dependent claims.

The invention will be explained in more detail in the following with reference to embodiments and to the drawing. There are shown in the drawing, partly in section:

FIG. 1: an embodiment of a set of multicomponent cartridges in accordance with the invention in a perspective representation;

FIG. 2: the set of FIG. 1 in a view;

FIG. 3: the set of FIG. 2 in a view of the base of the multicomponent cartridges; and FIG. 4: one of the multicomponent cartridges of the set in a longitudinal section representation.

FIG. 1 shows in a perspective representation an embodiment of a set of multicomponent cartridges in accordance with the invention which is designated as a whole by the reference numeral 1 and here includes four multicomponent cartridge 2.

In the following, reference is made with exemplary character to the application particularly relevant to practice that the multicomponent cartridges 2 are each two-component cartridges 2. It is, however, understood that the invention is not restricted to such embodiments, but can also include in accordingly the same manner multicomponent cartridges 2 for more than two components.

Figure 4:
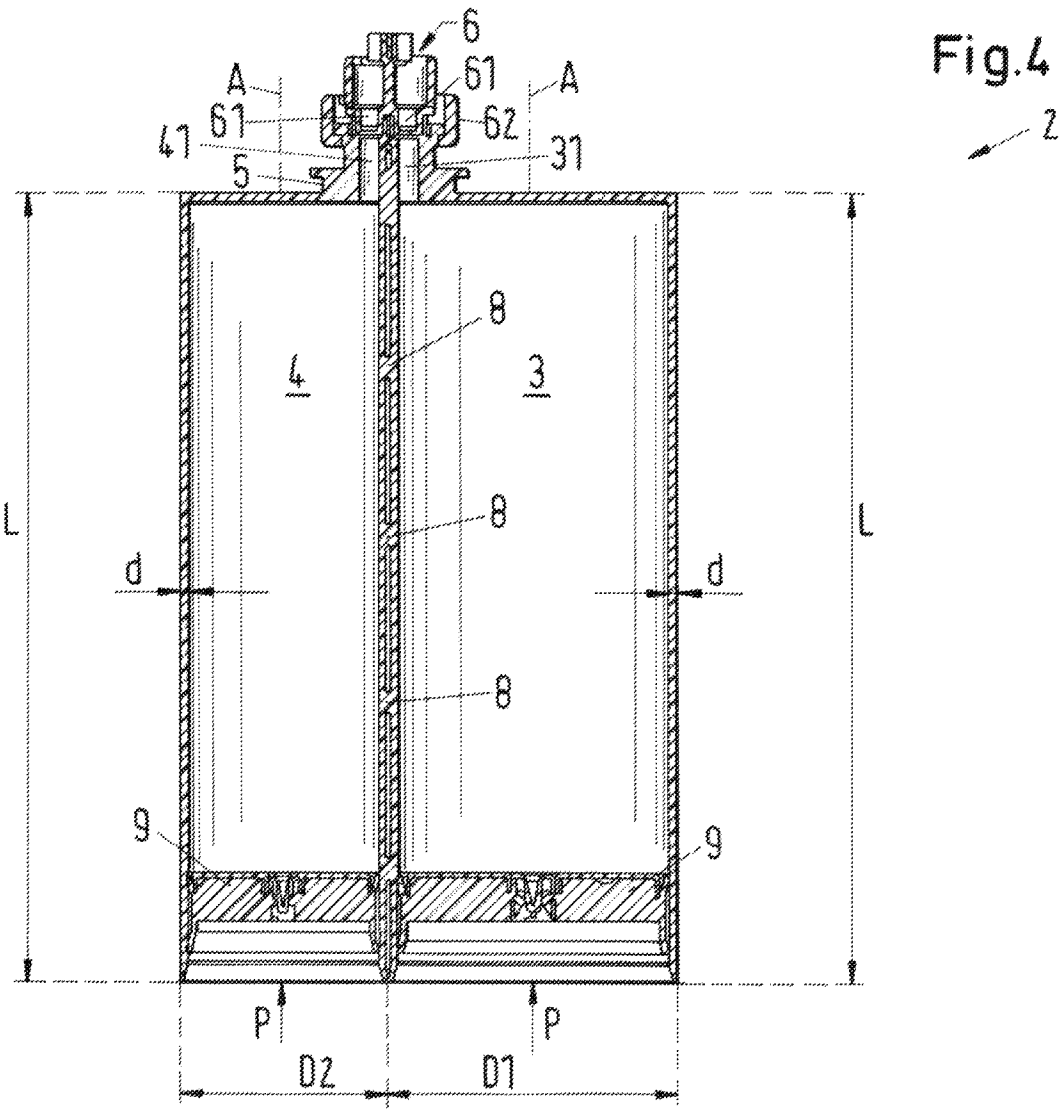

For better understanding, FIG. 4 shows one of the multicomponent cartridges 2 in a longitudinal section representation along the longitudinal direction A.

Each of the two-component cartridges 2 includes a first reception chamber 3 for a first component and a second reception chamber 4 for the second component. Each of the reception chambers 3, 4 is substantially cylindrical in design and extends in a longitudinal direction A which corresponds to the cylinder axis. The two-component cartridges 2 of the set 1 are so-called side-by-side cartridges, that is the two reception chambers 3, 4 of the two-component cartridges 2 are arranged next to one another so that their cylinder axes, which each extend in the direction of the longitudinal direction A, are parallel to one another. The length L of the first reception chamber 3 is the same as the length L of the second reception chamber 4, with the extent of the respective reception chamber 3, 4 in the longitudinal direction A being meant by the length L.

It is admittedly preferred, but not necessarily the case, that the length L is always the same for all multicomponent cartridges 2 of the set 1. The two reception chambers 3, 4 admittedly always have the same length L in each multicomponent cartridge 2, but it is by all means possible that this length L is different for different multicomponent cartridges 2 of the same set 1.

The first and the second reception chambers 3 and 4 respectively have a separate outlet 31 and 41 respectively (see FIG. 4) which is in each case provided in the end surface of the cylindrical reception chamber 3, 4 at the top in accordance with the representation and by which the respective component can be dispensed from the reception chamber. Each outlet 31, 41 has a circular cross-section and is designed in passage form.

Each two-component cartridge 2 has a common connector piece 5 which connects the two end faces of the reception chambers with the outlets 31, 41. The outlets 31 and 41 are arranged in this connector piece 5. The common connector piece 5 is designed for the cooperation with an accessory part.

In the embodiment described her, each multicomponent cartridge is shown with a closure cap 6 which cooperates with the connection part 5. The closure cap 6 has two spigots 61 of which each engages into one of the two outlets 31, 41 to close them. The closure cap 6 has a screw connection 62 which cooperates with a thread of the connector piece 5.

Each of the two-component cartridges 2 is manufactured in one piece so that their reception chambers 3, 4 are each non-releasably connected to one another, that is the two reception chambers 3, 4 cannot be separated from one another in a non-destructive manner. The two storage chambers 3, 4 are connected to one another via a plurality of parts, namely by the common connector piece 5 at its end face having the outlets 31, 41, by a connector bar 7 (see FIG. 3) at the end of the reception chambers 3, 4 remote from the outlets and by a plurality of intermediate bars 8 (see FIG. 4) which connect the cylindrical walls of the reception chambers 3, 4 to one another at different levels with respect to the longitudinal direction A.

Each two-component cartridge 2 is preferably manufactured in an injection molding process. Since the two-component cartridges 2 are in one piece, they can be manufactured in a simple and inexpensive manner in a single-stage injection molding process.

The multicomponent cartridges 2 are composed of plastic, with all plastics usually used for cartridges being suitable, for example polyamide (PA), polypropylene (PP), polyethylene (PE), polybutylene terephthalat (PBT) or polyolefins in general.

Figure 3:
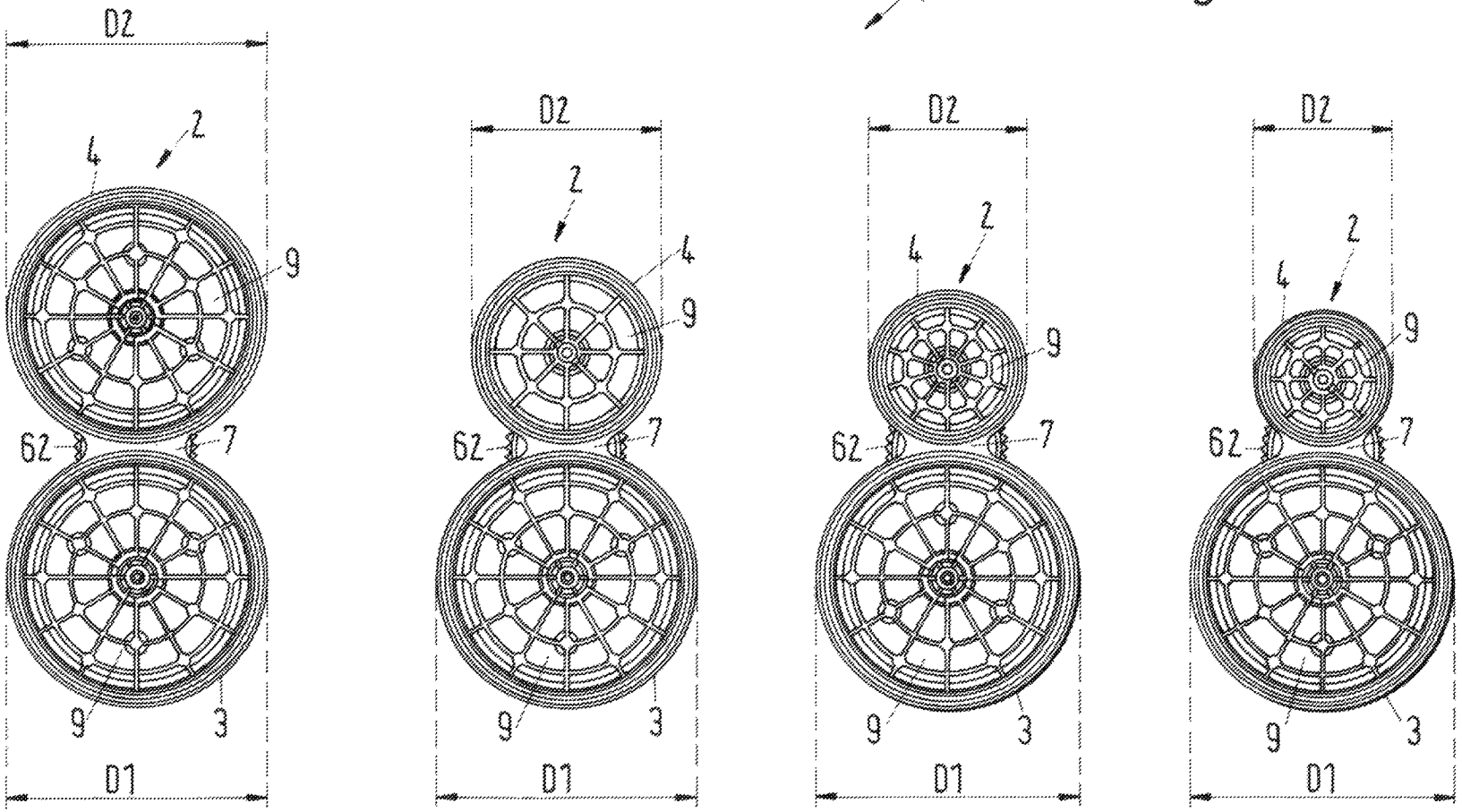
FIG. 3 shows a view of the base of the multicomponent cartridges 2, that is a view from the direction of gaze shown by the arrow III in FIG. 3.

As can in particular be recognized in FIGS. 3 and 4, the two-component cartridges 2 are each shown with an inserted piston 9 in each reception chamber 3, 4. This piston 9 is manufactured separately from the two-component cartridge 2 and is usually only inserted after the filling of the reception chambers 3, 4. The two-component cartridges 2 are therefore first manufactured in an injection molding process and then closed, for example, using the closure cap 6 at the outlets 31, 41. The respective components are then filled into the first or second reception chamber 3 and 4 respectively from the still open end of the reception chambers 3, 4 at the bottom in the illustration. Subsequently, a respective piston 9 is inserted into the reception chamber 3 and 4 respectively, said piston then forming the respective chamber base and sealingly closing the reception chamber 3, 4. The pistons 9 are frequently designed as valve pistons so that, on the insertion of the pistons 9, the air which may be present between the component and the piston can be removed in a simple manner.

To use the two-component cartridge 2, it is usually inserted into the holder of a dispensing apparatus (dispenser). The closure cap 6 is removed, unscrewed here, and a mixer is fastened to the common connector piece in its place, here therefore with a screw connection. This mixer is frequently a static mixer known per se which then has two separate inlets which each form a flow connection with one of the outlets 31, 41 so that the respective component moves from the reception chamber 3 and 4 respectively through the outlet 31 and 41 respectively into the mixer. The two components meet one another here and are mixed intimately with one another on passing through the mixer.

For dispensing the components, the dispensing apparatus usually has a double plunger or two individual plungers which apply pressure to the two pistons 9 in the first and second reception chambers 3 and 4 respectively, as is indicated in FIG. 4 by the two arrows with the reference symbol P.

The two pistons 9 simultaneously slide upward in accordance with the presentation along the inner wall of the first or second reception chambers 3 and 4 respectively due to the application of pressure, whereby the respective components are dispensed into the mixer. After ending the application, the mixer can be removed again and can be replaced by the closure cap 6.

The connection of the common connection piece 5 to the closure cap 6 or to the mixer can naturally also take place in another manner than by a screw connection, for example by means of a bayonet connection. The connection piece 5 has a bayonet coupling in a manner known per se which cooperates with a bayonet coupling provided at the closure cap 6 or at the mixer or at another accessory part such that the two parts are reliably connected to one another.

The set 1 of multicomponent cartridges 2 in accordance with the invention is in particular characterized in that in each of the at least two multicomponent cartridges 2, the first reception chamber 3 has the same outer diameter D1. It can be realized by this measure that all multicomponent cartridges 2 of the set 1 can be inserted into the same dispensing device. Since namely the multicomponent cartridges 2 are in one piece, the two reception chambers 3 and 4 respectively are rigidly connected to one another—here by the connector piece 5, the connection bar 7 and the intermediate bars 8—it is sufficient that the holder in the dispensing device is designed so that it receives the first reception chamber 3 reliably and firmly. The outer diameter D2 of the second reception chamber 4 can then vary without the secure and reliable dispensing function being endangered thereby.

It is preferred for technical manufacturing reasons that every first reception chamber 3 of a set 1 has the same volume. With the same length L, this means that the wall thickness d of the wall of the first reception chamber 3 is the same for all multicomponent cartridges 2 of the set 1. It is, however, also possible and optionally desirable for some applications that the wall thickness d of the wall of the first reception chamber 3 has different values for two different multicomponent cartridges 2 which belong to the same set 1.

If all first reception chambers 3 have the same wall thickness d , they also have the same inner diameter. This is particularly advantageous because then the same piston 9 can be used for all the first reception chambers 3; no pistons 9 with different diameters therefore then have to be provided for the first reception chambers 3.

It is thus possible by the variation of the outer diameter D2 of the second reception chamber 4 to realize different mixing ratios for the two components. In this respect, what is meant by the mixing ratio is how many parts of the first component there are to one part of the second component. A mixing ratio of 2:1 means, for example, that there are two parts of the first component to one part of the second component, with volume parts being meant by parts here.

Since the two reception chambers 3, 4 of the two-component cartridges 2 are of equal length and the two pistons 9 are usually pushed forward synchronously and in parallel on the dispensing of the two components, the mixing ratio can be set via the diameter D2 of the second reception chamber 4. The mixing ratio is then given by the ratio of the two circular cross-sectional surfaces of the two reception chambers 3, 4 in each case perpendicular to the longitudinal direction A. If the wall thicknesses d of the first and second reception chambers 3 and 4 respectively are the same—which is as a rule the case—the mixing ratio is defined by the ratio of the outer diameter D1 of the first reception chamber 3 to the outer diameter D2 of the second reception chamber 4. This statement also applies at least approximately with an unequal wall thickness d of the two reception chambers 3, 4.

Figure 1:
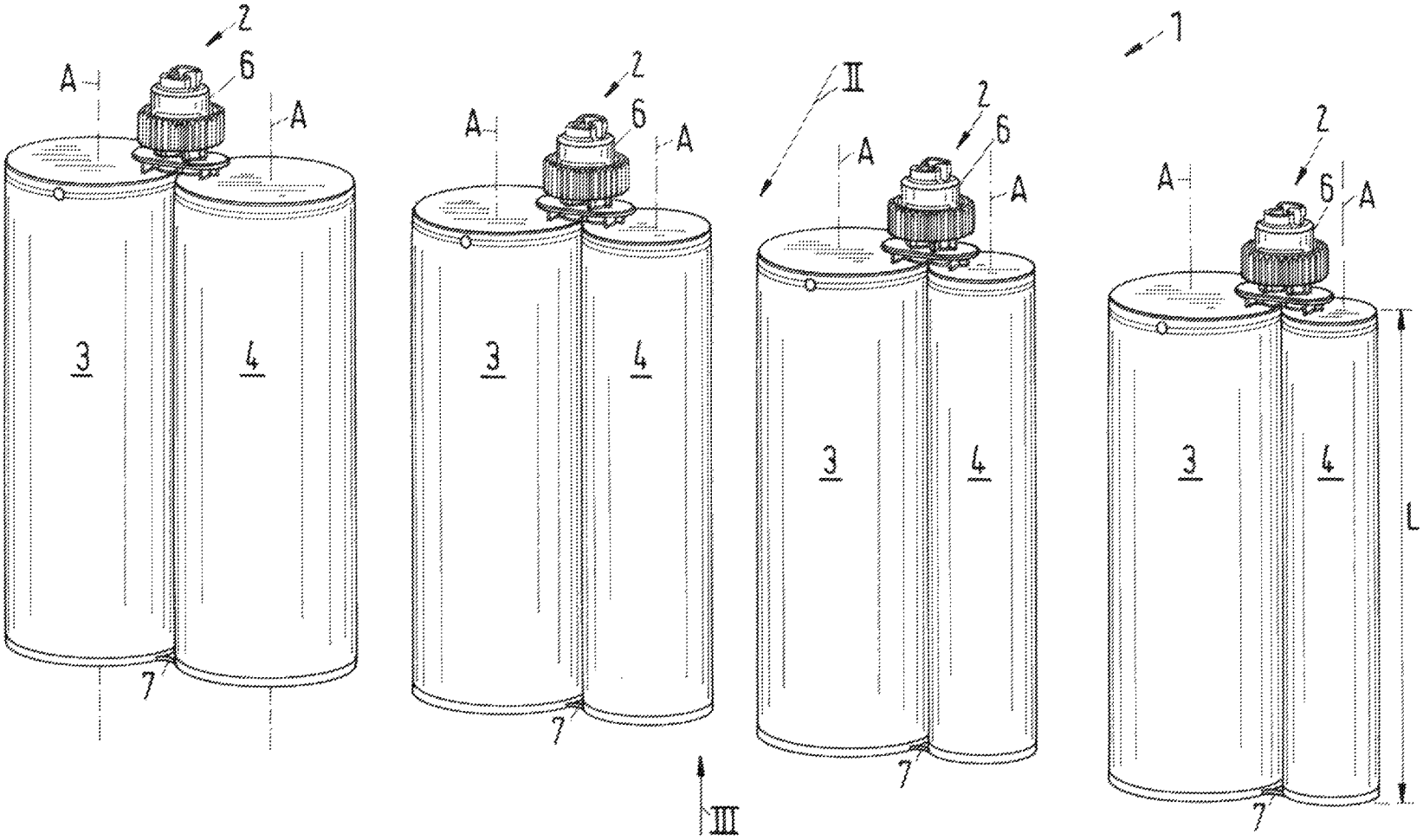

In the set 1 shown in FIG. 1, the following mixing ratios are realized in the four two-component cartridges 2 from left to right in accordance with the illustration: 1:1; 2:1; 3:1; and 4:1.

Figure 2:
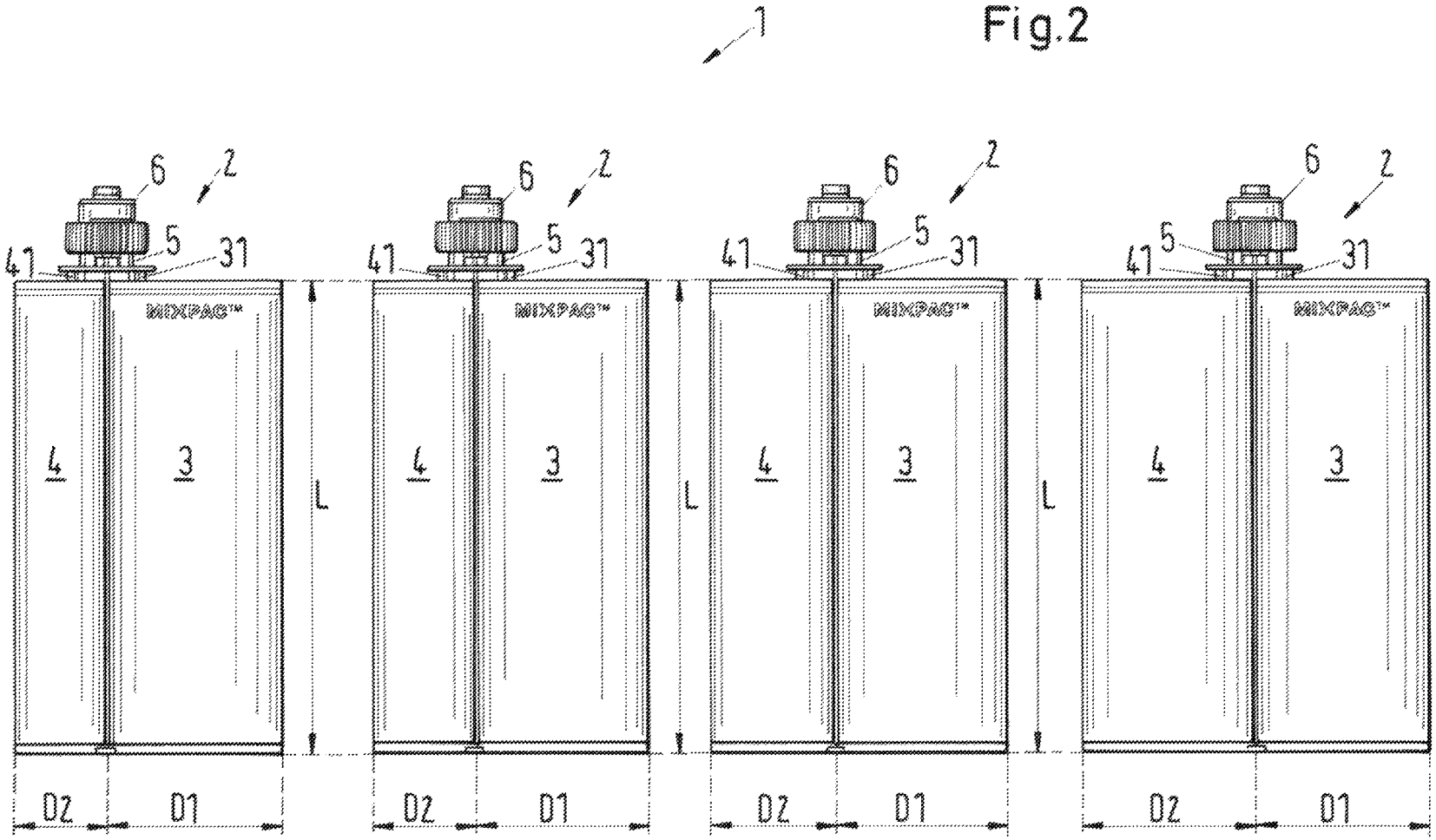
FIG. 2 shows the set 1 of FIG. 1 in a view from the direction of gaze shown by the arrow II in FIG. 1.

The order in FIGS. 2 and 3 is exactly the opposite due to the direction of gaze. The respective multicomponent cartridge 2 at the extreme left in accordance with the illustration here has the mixing ratio 4:1; the mixing ratios 3:1; 2:1 and 1:1 follow to the right.

The multicomponent cartridge 2 shown in section in FIG. 4 has the mixing ratio 2:1

Since the cross-sectional areas of the reception chambers 3, 4 perpendicular to the longitudinal direction A are circular areas in each case, the ratio of the outer diameter D1 of the first reception chamber 3 to the outer diameter D2 of the second reception chamber 4 has the value 2 for the mixing ration 4:1; the value square root of three for the mixing ratio 3:1; and the value square root of 2 for the mixing ratio 2:1. The outer diameter D1 of the first reception chamber 3 is equal to the outer diameter D2 of the second reception chamber 4 for the mixing ratio 1:1.

It is naturally understood that the set 1 of multicomponent cartridges 2 can alternatively or additionally also include further multicomponent cartridges 2 with different mixing ratios.

The invention claimed is:

1. A set of multicomponent cartridges comprising:

at least a first multicomponent cartridge and a second multicomponent cartridge, each of the first and second multicomponent cartridges including at least one first reception chamber and at least one second reception chamber, each of the first and second reception chambers being configured to dispense a component and having a substantially cylindrical structure, the first and second reception chambers further being arranged parallel to one another and having a same length in the longitudinal direction and being non-releasably connected to one another, each of the first reception chambers having a first outer diameter, the first outer diameter of each multicomponent cartridge of the set being the same, each of the second reception chambers having an outer diameter, at least one of the outer diameters of the second reception chambers being different from another one of the outer diameters of the second reception chambers such that at least two multicomponent cartridges in the set are suitable for different mixing ratios.

2. The set in accordance with claim 1, wherein each of the first reception chambers of the set has a first volume, each of the first volumes being the same.

3. The set in accordance with claim 2, wherein the first reception chamber of the first multicomponent cartridge has the first volume, the second reception chamber of the first multicomponent cartridge having a second volume, the first and second volumes being the same.

4. The set in accordance with claim 1, wherein each multicomponent cartridge is a two-component cartridge.

5. The set in accordance with claim 1, wherein each multicomponent cartridge of the at least first and second multicomponent cartridges is manufactured by an injection molding process.

6. The set in accordance with claim 1, wherein each of the first and second reception chambers has an outlet through which the component can be dispensed.

7. The set in accordance with claim 6, wherein each multicomponent cartridge of the at least first and second multicomponent cartridges includes a common connector piece configured to cooperate with an accessory part, the outlets being arranged in the connector piece.

8. The set in accordance with claim 7, wherein the connector piece has a thread configured to cooperate with the accessory part.

9. The set in accordance with claim 7, wherein the connector piece has a bayonet coupling configured to cooperate with the accessory part.

10. The set in accordance with claim 7, wherein the accessory part is one of a closure cap and a mixer.

11. The set in accordance with claim 6, wherein each of the first and second reception chambers includes a piston forming the chamber base, the piston being configured to dispense the component upon receiving pressure.

12. The set in accordance with claim 1, wherein the first reception chamber of the first multicomponent cartridge has a first volume, the second reception chamber of the first multicomponent cartridge has a second volume, the ratio of the first volume to the second volume being two to one.

13. The set in accordance with claim 1, wherein the first reception chamber of the first multicomponent cartridge has a first volume, the second reception chamber of the first multicomponent cartridge has a second volume, the ratio of the first volume to the second volume being three to one.

14. The set in accordance with claim 1, wherein the reception chamber of the first multicomponent cartridge has a first volume the second reception chamber of the first multicomponent cartridge has a second volume, the ratio of the first volume to the second volume being four to one.

15. The set in accordance with claim 1, wherein each of the first and second reception chambers of the at least first and second multicomponent cartridges has a same wall thickness.

16. The set in accordance with claim 1, wherein each of the first reception chambers of the at least first and second multicomponent cartridges has a same inner diameter such that each of the first reception chambers has the same volume.

17. A set of multicomponent cartridges comprising:

at least a first multicomponent cartridge and a second multicomponent cartridge, each of the first and second multicomponent cartridges including at least one first reception chamber and at least one second reception chamber, each of the first and second reception chambers being configured to dispense a component and having a substantially cylindrical structure, the first and second reception chambers further being arranged parallel to one another and having a same length in the longitudinal direction and being non-releasably connected to one another, each of the first reception chambers having a first outer diameter, the first outer diameter of each multicomponent cartridge of the set being the same, each of the second reception chambers having an outer diameter, at least two of the outer diameters of the second reception chambers being different such that at least two multicomponent cartridges in the set are suitable for different mixing ratios; and a common connector piece configured to receive the outlets of each of the first and second reception chambers of the multicomponent cartridges such that the common connector piece is compatible with each multicomponent cartridge to dispense a component, the common connector piece further being configured to cooperate with a closure cap or a mixer.

* * * * *